US008373398B2

(12) United States Patent
Kim

(10) Patent No.: US 8,373,398 B2
(45) Date of Patent: Feb. 12, 2013

(54) AREA-EFFICIENT VOLTAGE REGULATORS

(75) Inventor: Wooseok Kim, Gunpo-Si (KR)

(73) Assignee: Analog Devices, Inc., Norwood, MA (US)

( * ) Notice: Subject to any disclaimer, the term of this patent is extended or adjusted under 35 U.S.C. 154(b) by 323 days.

(21) Appl. No.: 12/890,215

(22) Filed: Sep. 24, 2010

(65) Prior Publication Data

US 2012/0074921 A1 Mar. 29, 2012

(51) Int. Cl.
*G05F 1/40* (2006.01)

(52) U.S. Cl. ..... 323/271; 323/280

(58) Field of Classification Search ..... 323/223, 323/225, 226, 268–273, 275, 280, 281, 282, 323/285
See application file for complete search history.

(56) References Cited

U.S. PATENT DOCUMENTS

| | | | | |
|---|---|---|---|---|
| 6,188,211 | B1 | 2/2001 | Rincon-Mora et al. | 323/280 |
| 6,333,623 | B1 | 12/2001 | Heisley et al. | 323/280 |
| 6,661,211 | B1 | 12/2003 | Currelly et al. | 323/268 |
| 7,116,088 | B2 | 10/2006 | Tran et al. | 323/282 |
| 7,205,827 | B2 | 4/2007 | Leung et al. | 327/540 |
| 7,298,567 | B2 | 11/2007 | Poss | 360/46 |
| 7,482,790 | B2 | 1/2009 | Eberlein | 323/270 |
| 7,737,666 | B2 * | 6/2010 | Sutardja et al. | 323/222 |
| 7,755,339 | B2 * | 7/2010 | Kojima et al. | 323/280 |
| 8,248,145 | B2 * | 8/2012 | Melanson | 327/432 |

OTHER PUBLICATIONS

Milliken, Robert J., "Full On-Chip CMOS Low-Dropout Voltage Regulator", IEEE Transactions on Circuits and Systems, vol. 54, No. 9, Sep. 2007, pp. 1879-1890.
Patoux, Jerome, "Low-Dropout Regulators", Analog Dialogue, vol. 41, Analog Devices, Inc. May 2007, 3 pages.
"Understanding Power MOSFETs", Fairchild Semiconductor Corporation, Application Note AN-7500, Oct. 1999, 4 pages.

* cited by examiner

*Primary Examiner* — Matthew Nguyen
(74) *Attorney, Agent, or Firm* — Koppel, Patrick, Heybl & Philpott

(57) ABSTRACT

Area-efficient voltage regulators are provided in which a first transistor has a first breakdown voltage and a first on-state resistance and a second transistor has a second breakdown voltage that exceeds the first breakdown voltage and a second on-state resistance that exceeds the first on-state resistance. With this arrangement, the second transistor can be biased to raise an output voltage. When the difference between an input voltage and the output voltage is less than a predetermined voltage, the second transistor is disabled and the first transistor is controlled to provide the output voltage at a wherein the controlling is preferably performed with a feedback control loop. The die area of the first transistor can be reduced because its on-state breakdown need only exceed the predetermined voltage rather than the substantially-higher input voltage. Because of the reduced on-state breakdown, the die area of the first transistor can be reduced and still obtain a low on-state resistance $r_{DS(ON)}$ that will enhance the efficiency of the voltage regulator. The die area of the second transistor can be reduced because this transistor is not on after the difference between the output voltage and the input voltage is within the predetermined voltage. The second transistor can therefore be configured with a high on-state resistance $r_{DS(ON)}$ without degrading the performance of the voltage regulator. The die area of the second transistor can thus be reduced while still obtaining breakdown voltages greater than the input voltage.

15 Claims, 1 Drawing Sheet

AREA-EFFICIENT VOLTAGE REGULATORS

BACKGROUND OF THE INVENTION

1. Field of the Invention

The present invention relates generally to voltage regulators.

2. Description of the Related Art

A voltage regulator is an electrical regulator designed to automatically maintain an output voltage at a desired constant level. Electronic voltage regulators generally operate by comparing the present output voltage to some internal fixed reference voltage in a negative feedback control loop. The difference is then used to reduce the error between the present voltage and the desired voltage.

There are at least two broad types of voltage regulators. Switching regulators rapidly switch a series device on and off. These regulators are highly efficient because the switching element is either on or off so that it dissipates very little power. In contrast, linear regulators are constructed around devices that operate in their linear region. Although linear regulators provide a low-noise output signal, they are typically less efficient than switching regulators.

Linear voltage regulators always require the output voltage to be less than the input voltage. The difference between the input and the output voltages at which the circuit can no longer regulate the output voltage is referred to as the dropout voltage. A low-dropout (LDO) linear regulator is one which can operate with a very small dropout voltage.

Die area of a regulator is the area of an integrated circuit chip required by that regulator. Because die area is always a limited resource, an area-efficient voltage regulator is a valuable asset.

BRIEF SUMMARY OF THE INVENTION

The present invention is generally directed to area-efficient voltage regulators. The drawings and the following description provide an enabling disclosure and the appended claims particularly point out and distinctly claim disclosed subject matter and equivalents thereof.

DETAILED DESCRIPTION OF THE INVENTION

Figure 1:
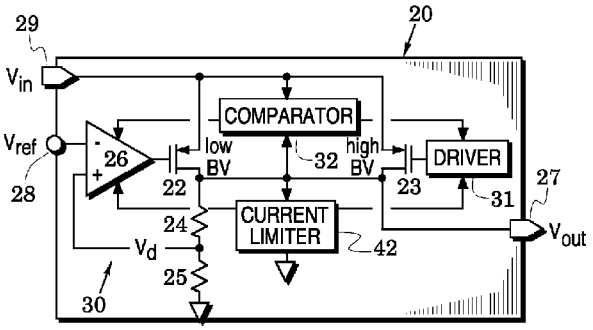
FIG. 1 is a schematic of a voltage regulator embodiment.

FIG. 1 illustrates a voltage regulator embodiment 20 that has a first transistor 22 configured to have a first breakdown voltage and a first on-state resistance. The regulator also has a second transistor 23 with a second breakdown voltage that exceeds the first breakdown voltage and a second on-state resistance that exceeds the first on-state resistance. As shown in FIG. 1, the first and second transistors are coupled in parallel between an input voltage $V_{in}$ and an output port 27.

With this arrangement, the second transistor can be biased to raise the output voltage. When the difference between the input voltage $V_{in}$ and the output voltage is less than a predetermined voltage $V_{pred}$, the second transistor 23 is disabled and the first transistor 22 is controlled to provide the output voltage at a predetermined output level $V_{out}$ wherein the controlling is preferably performed with a feedback control loop 30.

This regulating process facilitates a significant reduction in the die area of the first and second transistors 22 and 23. The die area of the first transistor 22 can be reduced because its on-state breakdown need only exceed the predetermined voltage $V_{pred}$ rather than the substantially-higher input voltage $V_{in}$. Because of the reduced on-state breakdown, the die area of the first transistor can be reduced and still obtain a low on-state resistance $r_{DS(ON)}$ that will enhance the efficiency of the voltage regulator 20.

The die area of the second transistor 23 can be reduced because this transistor is not on after the difference between the output voltage and the input voltage $V_{in}$ is within the predetermined voltage $V_{pred}$. The second transistor 23 can therefore be configured with a high on-state resistance $r_{DS(ON)}$ without degrading the performance of the voltage regulator 20. The die area of the second transistor 23 can thus be reduced while still obtaining breakdown voltages greater than the input voltage $V_{in}$.

With the voltage regulator embodiment 20, it has been found that the total die area for the first and second transistors 22 and 23 can be substantially reduced from the die area needed when a voltage regulator is realized with a single transistor, e.g., the transistor 22. The reduction in die area may facilitate a reduction in chip cost and/or an increase in die area for other electronic components.

In particular, FIG. 1 illustrates a voltage regulator embodiment 20 that is useful for reducing the die area of an integrated circuit. The regulator includes a transistor 22, resistors 24 and 25, and a differential amplifier 26. Resistors 24 and 25 are coupled together and resistor 24 is coupled to the output terminal (e.g., drain) of the transistor 22. This same output terminal provides an output voltage $V_{out}$ at an output port 27 of the regulator. Relative to this output voltage $V_{out}$, resistors 24 and 25 act as a voltage divider to provide a divided voltage $V_d$ at the positive input of the differential amplifier 26. The transistor 22 receives an input voltage $V_{in}$ from an input port 29.

The divided voltage $V_d$ between the resistors 24 and 25 is fed back to the positive input of the differential amplifier 26 and the amplifier's negative input is biased with a reference voltage $V_{ref}$ that is applied at a reference port 28. The transistor 22 is thus controlled by a feedback control loop 30 that includes the resistors 24 and 25 and the differential amplifier 26. Because of the voltage divider, the divided voltage $V_d$ will be:

$$V_d = \frac{R_{25}}{R_{24} + R_{25}} V_{out}. \tag{1}$$

The DC gain of the operational amplifier 26 is quite large so that the difference between the reference voltage $V_{ref}$ and the divided voltage $V_d$ is substantially zero. Replacing the divided voltage $V_d$ with the reference voltage $V_{ref}$ in equation (1) and rearranging the equation provides an expression for the output voltage $V_{out}$ of:

$$V_{out} = \frac{R_{24} + R_{25}}{R_{25}} V_{ref}. \tag{2}$$

It is noted that the reference voltage $V_{ref}$ may be provided by various stable circuits such as a bandgap reference.

Before the transistor 22 and the differential amplifier 26 were activated, it is obvious from FIG. 1 that the output voltage $V_{out}$ would have been zero. When these elements were activated, the output voltage would then rise from zero to its final value given in equation (2). Therefore, immediately upon turn-on of the regulator 20, the voltage across the transistor 22 would be the input voltage $V_{in}$. This voltage would then subsequently reduce to the difference between the input voltage $V_{in}$ and the final output voltage $V_{out}$. That is, the voltage across the transistor 22 would be $V_{in}$ at turn-on and reduce to a final value of $V_{in}-V_{out}$.

Breakdown voltages of the metal-oxide field-effect transistor (MOSFET) 22 include the on-state breakdown and the breakdown voltage $BV_{dss}$ which is breakdown drain-to-source with the gate shorted to the source. The breakdown voltage is generally somewhat greater than the on-state breakdown. Both may be increased by spacing elements of the transistor further apart but this unfortunately increases the on-state resistance $r_{DS(ON)}$ which is the on-state resistance between drain and source of the transistor 22. It is apparent from FIG. 1 that the breakdown voltages of transistor 22 must exceed the input voltage $V_{in}$ to insure it is not damaged.

The circuitry of FIG. 1 just recited above is generally referred to as a low-dropout voltage regulator. As noted above, the dropout voltage is the voltage across the transistor 22 at which it can no longer regulate the voltage across it. It is approximately equal to $r_{DS(ON)} \times I_L$ in which $I_L$ is the load current provided by the transistor 22. Regulator efficiency is enhanced when the on-state resistance $r_{DS(ON)}$ is reduced. The dropout voltage may be as low as a few hundred millivolts and the transistor 22 is connected in a common-source configuration so that this is the minimum difference between the input voltage $V_{in}$ and the output voltage $V_{out}$. The LDO regulator configuration of FIG. 1, therefore, is especially suited for regulating an output voltage that differs from the input voltage by a small amount.

As also noted above, low on-state resistance must be sacrificed if the MOSFET is to withstand higher breakdown voltages. However, this relationship holds only for a given die area. If the die area is increased, the breakdown voltage can be increased while still obtaining a low on resistance. Thus, the on-state resistance $r_{DS(ON)}$ varies directly with breakdown voltage and inversely with die area. If used alone in FIG. 1, the breakdown voltages of the transistor 22 would have to exceed the input voltage $V_{in}$ to insure this transistor is not damaged. To maintain a low on resistance $r_{DS(ON)}$, however, this requires an increased die area which is almost always a parameter in short supply.

To reduce the die area required for the transistor 22, the regulator 20 of FIG. 1 inserts a second transistor 23 in parallel with the first transistor 22, adds a driver 31 to bias the control terminal (e.g., gate) of the second transistor and inserts a comparator 32 to compare the output voltage $V_{out}$ to the input voltage $V_{in}$. In response to this comparison, the comparator 32 is arranged to control the driver 30 and the differential amplifier 26.

Figure 2:
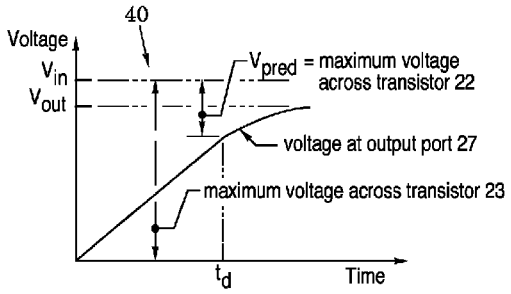
FIG. 2 is a diagram that illustrates operation of the regulator of FIG. 1.

An exemplary operation of the voltage regulator 20 is illustrated by the graph 40 of FIG. 2. The comparator 32 of FIG. 1 is configured to initially turn on the second transistor 23 and command the differential amplifier 26 to bias off the first transistor 22. The comparator 32 is further configured to compare the difference between the output voltage $V_{out}$ and the input voltage $V_{in}$ to a predetermined voltage $V_{pred}$ as shown in the graph 40.

The comparator 32 initially senses that difference between the input and output voltages is initially the input voltage which exceeds the predetermined voltage $V_{pred}$. Accordingly, the comparator commands the comparator 26 to bias off the first transistor 22 and activate the driver 34 to turn on the second transistor 23. In response, current flows through the second transistor 23 which causes the output voltage to rise as shown in the graph 40 of FIG. 1. When the difference between the input and output voltages reaches the predetermined voltage $V_{pred}$ after a delay time $t_d$, the comparator deactivates the driver 34 to turn off the second transistor 23 and activates the differential amplifier 26 so that feedback control loop 30 is activated. At this point, the first transistor 22 is exposed to its maximum voltage of the predetermined voltage $V_{pred}$.

As indicated in FIG. 2, feedback action of the control loop now continues to raise the output voltage at the output port 35 until the divided voltage $V_d$ across the resistor 25 substantially equals the reference voltage $V_{ref}$. From this point on, the control loop 30 holds the output voltage $V_{out}$ at this level which will be greater than the predetermined voltage $V_{pred}$ and less than the input voltage $V_{in}$.

From the graph 40 of FIG. 2, it is evident that, in the turn-on operation described above, the maximum voltage across the second transistor 23 when it is conducting current is the input voltage $V_{in}$. It is evident that the maximum voltage across the first transistor 22 is also the input voltage $V_{in}$ but, when the first transistor is conducting current, its maximum voltage is the predetermined voltage $V_{pred}$. When the maximum operational voltage seen by the first transistor 22 was $V_{in}$, this transistor's die area had to be substantially increased to obtain a low on-state resistance $r_{DS(ON)}$. Now that the on-state breakdown of transistor 22 need only exceed the predetermined voltage $V_{pred}$, the same low on-state resistance $r_{DS(ON)}$ can be obtained with a significantly-reduced die area.

The breakdown voltages seen by the second transistor 23 must exceed $V_{in}$ which was the case originally for the first transistor 22 when it was used alone. However, the second transistor 23 is only used momentarily upon startup of the voltage regulator 20 so that its performance parameters are not critical and its on-state resistance $r_{DS(ON)}$ can be allowed to take on a higher value. Accordingly, its die area can be significantly reduced from that of the first transistor 22 when it was used alone.

In summary of operation, the second transistor 23 is used to raise the output voltage from zero to within the predetermined voltage $V_{pred}$ of the input voltage $V_{in}$ and the first transistor 22 is then controlled by the control loop 30 to further raise the output voltage and then regulate it at its final value $V_{out}$. The die area of the first transistor 22 can be reduced because its on-state breakdown need only exceed the predetermined voltage $V_{pred}$ and the die area of the second transistor 23 can be reduced because this transistor can have a high on-state resistance $r_{DS(ON)}$ without degrading the performance of the voltage regulator 20. Accordingly, it has been found that the total die area for the first and second transistors can be substantially reduced from that needed when the voltage regulator was realized with a single transistor.

Figure 3:
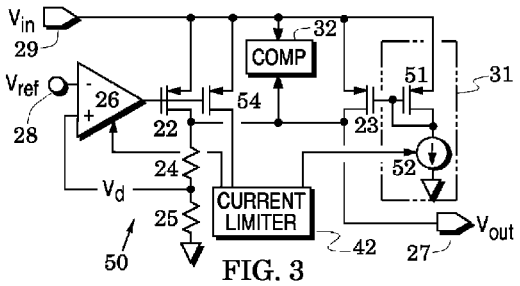
FIG. 3 is a schematic of another embodiment of portions of the regulator of FIG. 1.

FIG. 3 is a diagram 50 that illustrates portions of the voltage regulator 20 of FIG. 1 with like elements indicated by like reference numbers. This diagram includes a current limiter 42 that was shown in FIG. 1 for controlling and limiting currents of the voltage regulator 20. In addition, the diagram 50 shows an embodiment of the driver 31 of FIG. 1 that is formed with a transistor 51 that is gate-coupled to the second transistor 23. The gate and drain of transistor 51 are coupled together (i.e., the transistor 51 is diode-coupled) and then coupled to a current source 52 whose current can be set by the current limiter 32.

Accordingly, the current through transistors 23 and 51 can be controlled and limited during the time shown in the graph 40 of FIG. 2 in which the output voltage is increased from zero to the predetermined voltage $V_{pred}$. Because it only sets the gate-to-source bias of the second transistor 23, the size of the transistor 51 can be substantially reduced so that the die area of the voltage regulator is basically set by the size of the first and second transistors 22 and 23.

The diagram 50 also adds a small replica transistor 54 that is gate-coupled to the first transistor 22. The current through the replica transistor 54 is an indicator of the output current at the output port 27. The current limiter 42 is configured to respond to the current in the replica transistor 54 by commanding the differential amplifier 26 to safely limit the output current. It is therefore apparent that currents through the first and second transistors 22 and 23 can be safely limited to prevent damage to the voltage regulator when it is inadvertently connected to a load that would otherwise draw excessive current.

The embodiments of the invention described herein are exemplary and numerous modifications, variations and rearrangements can be readily envisioned to achieve substantially equivalent results, all of which are intended to be embraced within the spirit and scope of the appended claims.

I claim:

1. A voltage regulator to provide an output voltage at an output port in response to an input voltage at an input port, comprising:

first and second transistors having first current terminals coupled together to form said input port and having second current terminals coupled together to form said output port wherein said first transistor has a first breakdown voltage and said second transistor has a second breakdown voltage that exceeds said first breakdown voltage;

a voltage divider coupled to said second current terminals to provide a divided voltage less than said output voltage;

a differential amplifier coupled to drive a control terminal of said first transistor in response to the difference between said divided voltage and a reference voltage; and a comparator coupled to enable said differential amplifier and disable said second transistor when the difference between said input voltage and said output voltage is less than a predetermined voltage;

reduction of die area of said voltage regulator thereby facilitated because operational voltage across said first transistor restricted to less than said predetermined voltage and because said second transistor disabled after said difference is less than said predetermined voltage.

2. The regulator of claim 1, wherein said first transistor is configured with a first on-state breakdown voltage and said second transistor is configured with a greater second on-state breakdown voltage.

3. The regulator of claim 2, wherein said first transistor is configured with a first on-state resistance and said second transistor is configured with a greater second on-state resistance.

4. The regulator of claim 1, wherein said second transistor has a second control terminal and further including:

a current source; and a diode-coupled transistor gate-coupled to said second transistor and arranged to carry a current of said current source.

5. The regulator of claim 1, further including a replica transistor gate-coupled to said first transistor, current of said replica transistor thereby providing a measure of current in said first transistor.

6. The regulator of claim 1, wherein said first current terminals are sources and said second current terminals are drains.

7. A voltage regulator to provide an output voltage at an output port in response to an input voltage at an input port, comprising:

first and second transistors having first current terminals coupled together to form said input port and having second current terminals coupled together to form said output port wherein said first transistor has a first breakdown voltage and a first on-state resistance and said second transistor has a second breakdown voltage that exceeds said first breakdown voltage and a second on-state resistance that exceeds said first on-state resistance;

a feedback control loop configured to set a bias of a control terminal of said first transistor; and a comparator coupled to enable said control loop and disable said second transistor when the difference between said input voltage and said output voltage is less than a predetermined voltage;

reduction of die area of said voltage regulator thereby facilitated because operational voltage across said first transistor restricted to less than said predetermined voltage and because said second transistor disabled after said difference is less than said predetermined voltage 8. The regulator of claim 7, wherein said feedback control loop includes:

a voltage divider coupled to said second current terminals to provide a divided voltage less than said output voltage; and a differential amplifier coupled to drive said control terminal in response to the difference between said divided voltage and a reference voltage.

9. The regulator of claim 7, wherein said second transistor has a second control terminal and further including:

a current source; and a diode-coupled transistor gate coupled to said second transistor and arranged to carry a current of said current source.

10. The regulator of claim 7, further including a replica transistor gate-coupled to said first transistor, current of said replica transistor thereby providing a measure of current in said first transistor.

11. The regulator of claim 7, wherein said first current terminals are sources and said second current terminals are drains.

12. A method to regulate an output voltage, comprising the steps of:

providing a first transistor with a first breakdown voltage and a first on-state resistance and providing a second transistor with a second breakdown voltage that exceeds said first breakdown voltage and a second on-state resistance that exceeds said first on-state resistance;

with said first and second transistors coupled in parallel between an input voltage and an output port, biasing said second transistor to raise said output voltage; and when the difference between said input voltage and said output voltage is less than a predetermined voltage, disabling said second transistor and controlling said first transistor to provide said output voltage at a predetermined output level;

reduction of die area of said first and second transistors thereby facilitated because operational voltage across said first transistor restricted to less than said predetermined voltage and because said second transistor disabled after said difference is less than said predetermined voltage.

13. The method of claim 12, wherein said controlling step includes the step of controlling said first transistor with a feedback control loop.

14. The method of claim 12, wherein sources of said first and second transistors are coupled to receive said input voltage and drains of said first and second transistor are coupled to said output port.

15. The method of claim 12, wherein said output voltage is less than said input voltage and greater than said predetermined voltage.

* * * * *